US007417561B2

(12) United States Patent
Reed et al.

(10) Patent No.: US 7,417,561 B2
(45) Date of Patent: Aug. 26, 2008

(54) ACOUSTIC OR PNEUMATIC PULSE TRANSFER SYSTEM FOR EVENT COUNTI NG

(75) Inventors: John W. Reed, Baltimore, MD (US); Roy Colquitt, Columbia, MD (US); Timothy K. Fielder, Doylestown, PA (US)

(73) Assignee: Progressive Engineering Technologies Corp., Columbia, MD (US)

( * ) Notice: Subject to any disclaimer, the term of this patent is extended or adjusted under 35 U.S.C. 154(b) by 134 days.

(21) Appl. No.: 11/387,717

(22) Filed: Mar. 24, 2006

(65) Prior Publication Data

US 2007/0222641 A1 Sep. 27, 2007

(51) Int. Cl.
*G08G 1/02* (2006.01)

(52) U.S. Cl. ..... 340/940; 340/665; 340/666; 340/933; 200/61.22; 200/86 A; 700/117

(58) Field of Classification Search ..... 340/940, 340/933, 941, 665, 666; 200/86 A; 701/117, 701/118

See application file for complete search history.

(56) References Cited

U.S. PATENT DOCUMENTS

| | | | |
|---|---|---|---|
| 3,949,355 | A | 4/1976 | Newmeyer |
| 4,365,124 | A | 12/1982 | Robinson |
| 4,908,483 | A | 3/1990 | Miller |
| 5,448,232 | A | 9/1995 | Tyburski |
| 5,450,077 | A | 9/1995 | Tyburski |
| 5,463,385 | A | 10/1995 | Tyburski |
| 5,661,474 | A | 8/1997 | Douglas |
| 6,417,785 | B1 | 7/2002 | Tyburski |
| 2003/0085817 | A1 | 5/2003 | Reed et al. |

*Primary Examiner*—Davetta W. Goins
(74) *Attorney, Agent, or Firm*—Foley & Lardner LLP

(57) ABSTRACT

An event sensing component includes a housing, wherein the housing includes a first tube that is provided along an entire length of the housing, and a second tube that is provided along the entire length of the housing. The housing also includes a first connector provided at one end of the first tube and configured to couple with a first bypass tube that is attached at another end to another traffic sensing component. The housing further includes a second connector provided at one end of the second tube and configured to couple with a second bypass tube that is attached at another end to the another traffic sensing component.

13 Claims, 7 Drawing Sheets

801

802

803

804

805

806

807

ACOUSTIC OR PNEUMATIC PULSE TRANSFER SYSTEM FOR EVENT COUNTING

BACKGROUND OF THE INVENTION

The invention is a method and apparatus for use when counting and classifying vehicular traffic, in general. In particular, the invention provides both a method and a portable, durable, apparatus for discriminating the counting and classification of vehicular traffic in multiple lanes when traveling in either the same or opposing directions.

DESCRIPTION OF THE RELATED ART

Systems exist which record events by counting pneumatic pulses. Vehicular traffic counters, which respond to pneumatic pulses when a vehicle crosses over a pneumatic tube, are one example of such systems. FIG. 1 illustrates one such conventional vehicular traffic counting system. FIG. 1 shows a system configured to count two lanes of traffic using four pneumatic tubes connected to a conventional acoustic or pneumatic pulse counter, used in traffic counting applications. In FIG. 1, a vehicle traveling in Lane 1 crosses and compresses pneumatic tubes 101, 102, 103 and 104, thereby creating four acoustic or pneumatic pulses. A vehicle traveling in lane 2 crosses only pneumatic tubes 102 and 104, creating only two acoustic or pneumatic pulses. Based on the timing of the signals it receives, counter 105 determines whether the vehicle has passed in lane one or lane two and increments the count appropriately. One difficulty with such systems is that they require a large number of pneumatic tubes, which must be individually installed across the road and connected to the counter. The large number of tubes and their individual connections requires long set-up times with consequent personal risk to the installing technician. Such systems are also susceptible to reliability problems resulting from the number of vulnerable connections. In addition, the pneumatic tubes themselves are subject to damage from the constant stress induced by vehicular traffic.

U.S. patent application Ser. No. 10/270,389, entitled Acoustic Pulse Transfer System for Event Counting, which is assigned to the same entity as this application, and which is incorporated in its entirety herein by reference, describes a three-tube traffic sensing system that is utilized to sense and count traffic passing through different lanes of a road. In that three-tube traffic sensing and counting system, the traffic count on each lane of the road is determined separately from the traffic count on the other lanes. The traffic sensing system utilizes one or more three-tube components connected to each other, or supplied as a single unit, whereby one such three-tube traffic component 301 is shown in FIG. 3. FIG. 2 shows the coupling of three separate three-tube traffic components 201, 202, 203 to each other, in order to separately count traffic on three lanes of a road (by way of a counter 204 that is connected to a road-side end the three-tube traffic component 203).

While such a traffic sensing system as described in U.S. patent application Ser. No. 10/270,389 has been successfully implemented in the field, it is desired to come up with a system that operates just as well as that three-tube traffic component system, but which is less costly to manufacture and easier and safer to set up in the field.

SUMMARY OF THE INVENTION

One aspect of the invention relates to a traffic sensing component, which includes a housing. The housing includes a first tube that is usually provided along an entire length of the housing. The housing also includes a second tube that may be provided along the entire length of the housing. The housing further includes a first connector provided at one end of the first tube that may be configured to couple with a first bypass tube and that is attached at some point along its length to a traffic sensing component, at another end to another traffic counting component. The housing still further includes a second connector provided at one end of the second tube and configured to couple with a second bypass tube that is attached at the other end to another traffic sensing component.

Another aspect of the invention relates to a traffic sensing system, which includes a three-tube traffic sensing component. The three-tube traffic sensing component includes a housing, a first tube provided in the center portion of the housing, the first or center tube being configured to detect traffic passing over a first lane of a road on which the three-tube traffic sensing component is provided, a second tube provided in the side portion of the housing, the second tube corresponding to a first bypass tube, and a third tube provided on the another side portion of the housing, the third tube corresponding to a second bypass tube. The traffic counting system also includes a two-tube traffic sensing component. The two-tube traffic sensing component includes a housing, a first tube that may be provided along an entire length of the housing, a second tube that may be provided along the entire length of the housing, a first connector provided at one end of the first tube and configured to couple with a first bypass tube that is attached at another end to another traffic counting component, and a second connector provided at one end of the second tube and configured to couple with a second bypass tube that is attached at another end to the another traffic sensing component. The two-tube traffic sensing component is provided on the second and third lanes of the road, and wherein the two-tube traffic sensing component is connected to the three-tube traffic sensing component so as to detect traffic passing over the second and third lanes of the road.

Other features and advantages of the present invention will become apparent to those skilled in the art from the following detailed description and accompanying drawings. It should be understood, however, that the detailed description and specific examples, while indicating preferred embodiments of the present invention, are given by way of illustration and not limitation. Many modifications and changes within the scope of the present invention may be made without departing from the spirit thereof, and the invention includes all such modifications.

BRIEF DESCRIPTION OF THE DRAWINGS

The exemplary embodiments will hereafter be described with reference to the accompanying drawings, wherein like numerals depict like elements, and.

DETAILED DESCRIPTION OF THE PREFERRED EMBODIMENTS

In the following description, for the purposes of explanation, numerous specific details are set forth in order to provide a thorough understanding of the present invention. It will be evident to one skilled in the art, however, that the exemplary embodiments may be practiced without these specific details. In other instances, structures and device are shown in diagram form in order to facilitate description of the exemplary embodiments.

Figure 3:
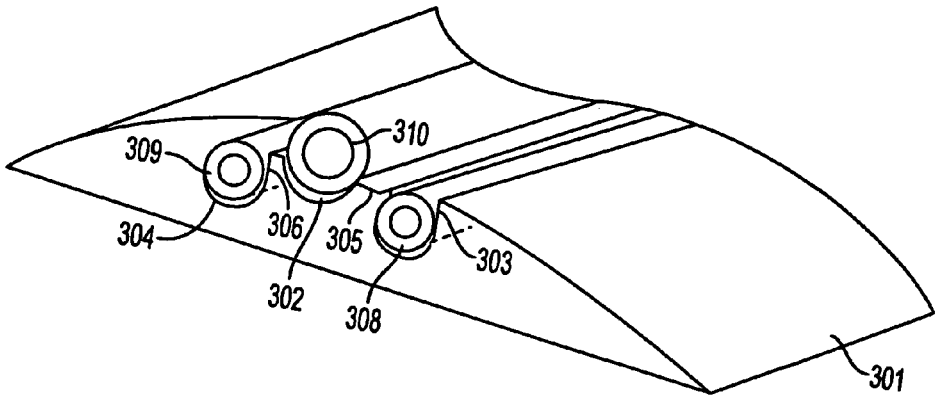
FIG. 3 shows a three-tube traffic sensing component as described in a related patent application.
Figure 4A:
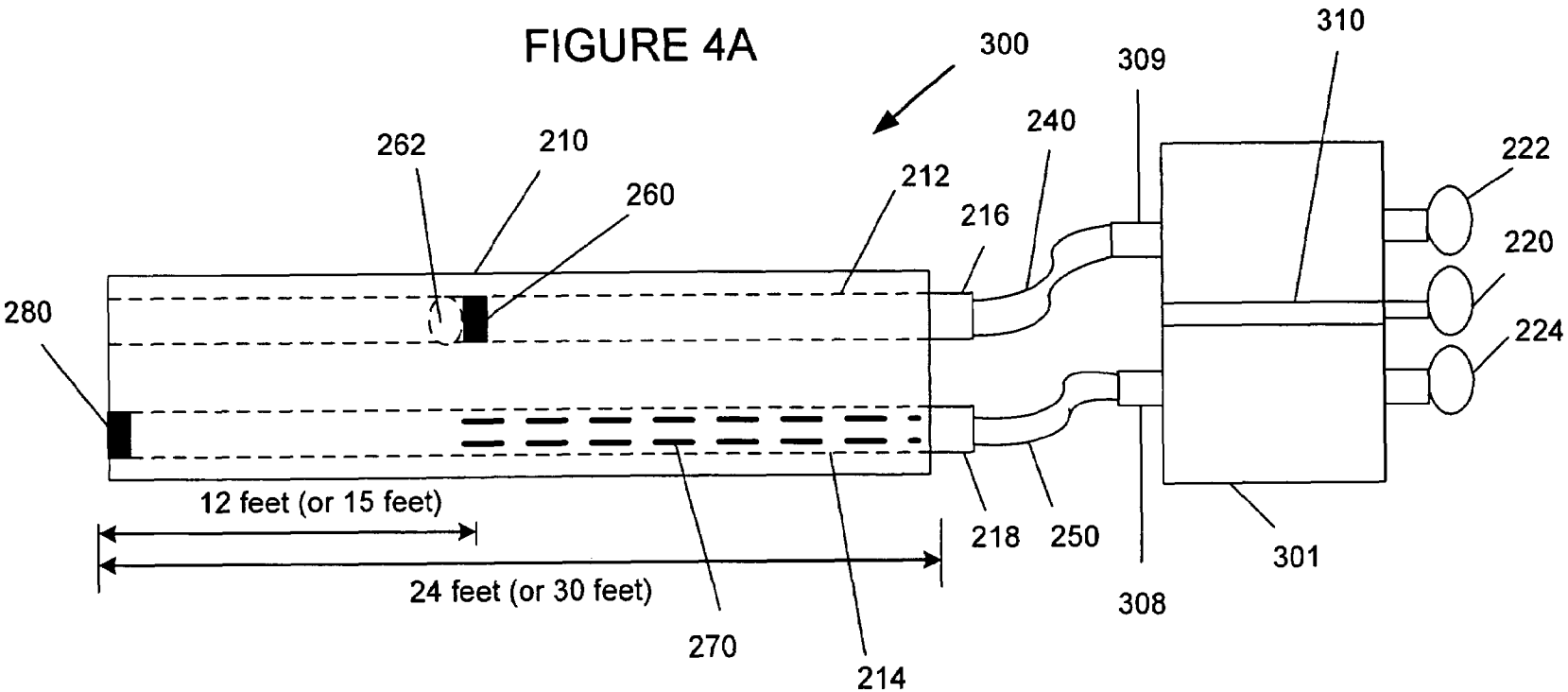
FIG. 4A shows a traffic sensing system according to a first embodiment of the invention.

FIG. 4A shows a traffic sensing system 300 according to a first embodiment of the invention. The traffic sensing system 300 includes a three-tube component 301, such as the one shown in FIG. 3, which is provided on a first lane of a road for which traffic is to be counted. As described in detail in U.S. patent application Ser. No. 10/270,389, the three-tube component 301 includes a center tube 310 and two side tubes 308, 309. The center tube 310 is seated within a groove or hole 302 of the three-tube component 301, whereby the center tube 310 is configured to identify vehicles on the first lane of traffic on which the center tube 310 is disposed. The side tube 308 is seated within a groove or hole 303 of the three-tube component, and the side tube 309 is seated within a groove or hole 304 of the three-tube component.

For a road which has 12-feet wide lanes, the three-tube component 301 is twelve (12) feet in length. For a road which has 15-feet wide lanes, the three-tube component 301 is fifteen (15) feet in length. As a vehicle passes over the three-tube component 301 on the first lane of the road, the vehicle deforms the center tube 310 to cause the top and bottom portions of the top tube 310 to compress or deform. This causes an acoustic or pneumatic pulse to occur within the interior of the center tube 310, whereby that acoustic or pneumatic pulse is detected and counted by a separate detector/counter (see counter 204 in FIG. 2, whereby this detector/counter may correspond to detector/counter 220 in FIG. 4) provided at the edge of the road closest to the first lane (the edge of the road being an area which traffic does not pass over). Based on the number of acoustic or pneumatic pulses received, a count can be obtained of the number of vehicles passing over the first lane of traffic within a particular time period (e.g., during rush hours between 6 a.m. and 9 a.m., or between 4 p.m. and 7 p.m.). The manner by which traffic is counted in the first lane of the road by a detector/counter attached to a traffic counting system is similar to that described in U.S. patent application Ser. No. 10/270,389.

Figure 1:
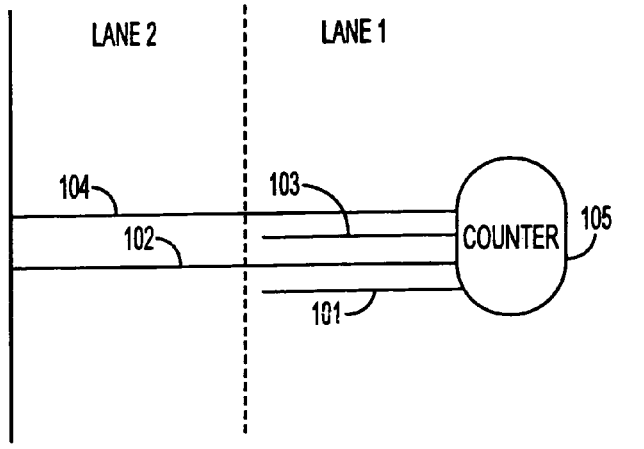
PRIOR ART FIGURE 1
FIG. 1 shows a conventional traffic sensing system.
Figure 2:
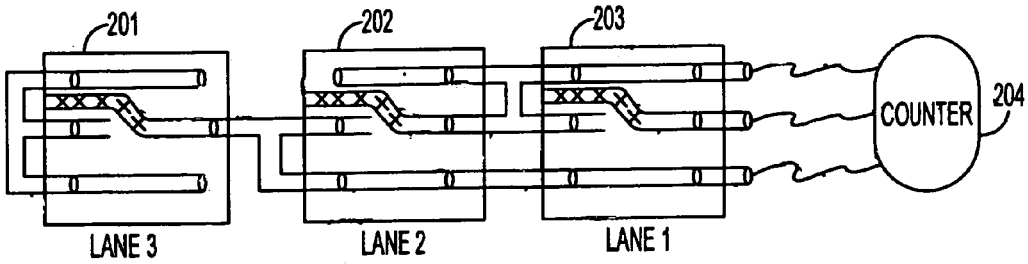
FIG. 2 shows a traffic counting system that utilizes only three-tube traffic sensing components, as described in a related patent application.

Unlike the traffic sensing system described in U.S. patent application Ser. No. 10/270,389, a two-tube component is utilized for sensing traffic in second and third lanes of the road (whereby multiple three-tube traffic components are used to count traffic in lanes other than the first lane in U.S. patent application Ser. No. 10/270,389, such as is shown in FIG. 2). In more detail, in the first embodiment, a two-tube component 210, which, for a 12-foot wide lane configuration, is 24 feet wide and is provided over second and third lanes of the road (total width of those two lanes being 24 feet), and whereby the two-tube component 210 is connected to the three-tube component 301, as shown in FIG. 4A. The left-side tube 309 of the three-tube component 301, referred to herein as a first bypass tube, is connected to a left-side tube 212 of the two-tube component 210, while the right-side tube 308 of the three-tube component 301, referred to herein as a second bypass tube, is connected to a right-side tube 214 of the two-tube component 210. For a 15-foot wide lane configuration, the two-tube component 210 is 30 feet in length, and spans the second and third lanes of a road having such 15-foot wide lanes.

Figure 5:
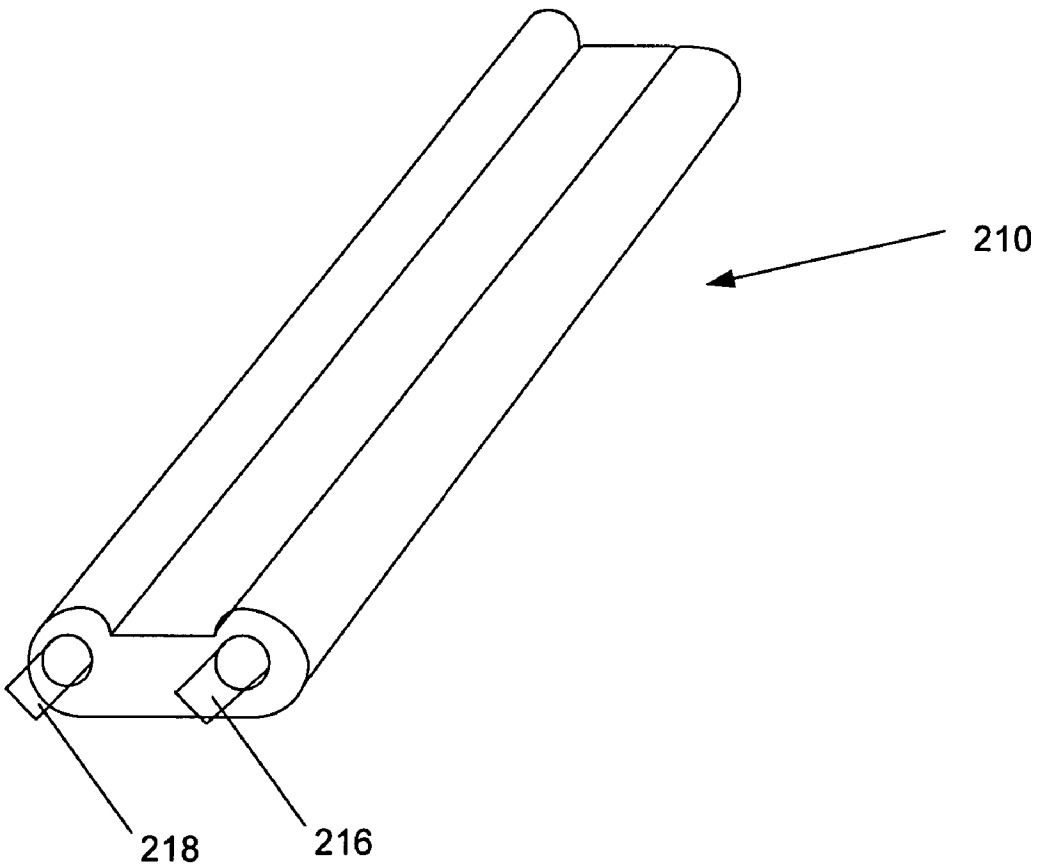
FIG. 5 shows a top perspective view of a two-tube traffic sensing component utilized in the systems shown in either FIG. 4A or 4B.
Figure 6:
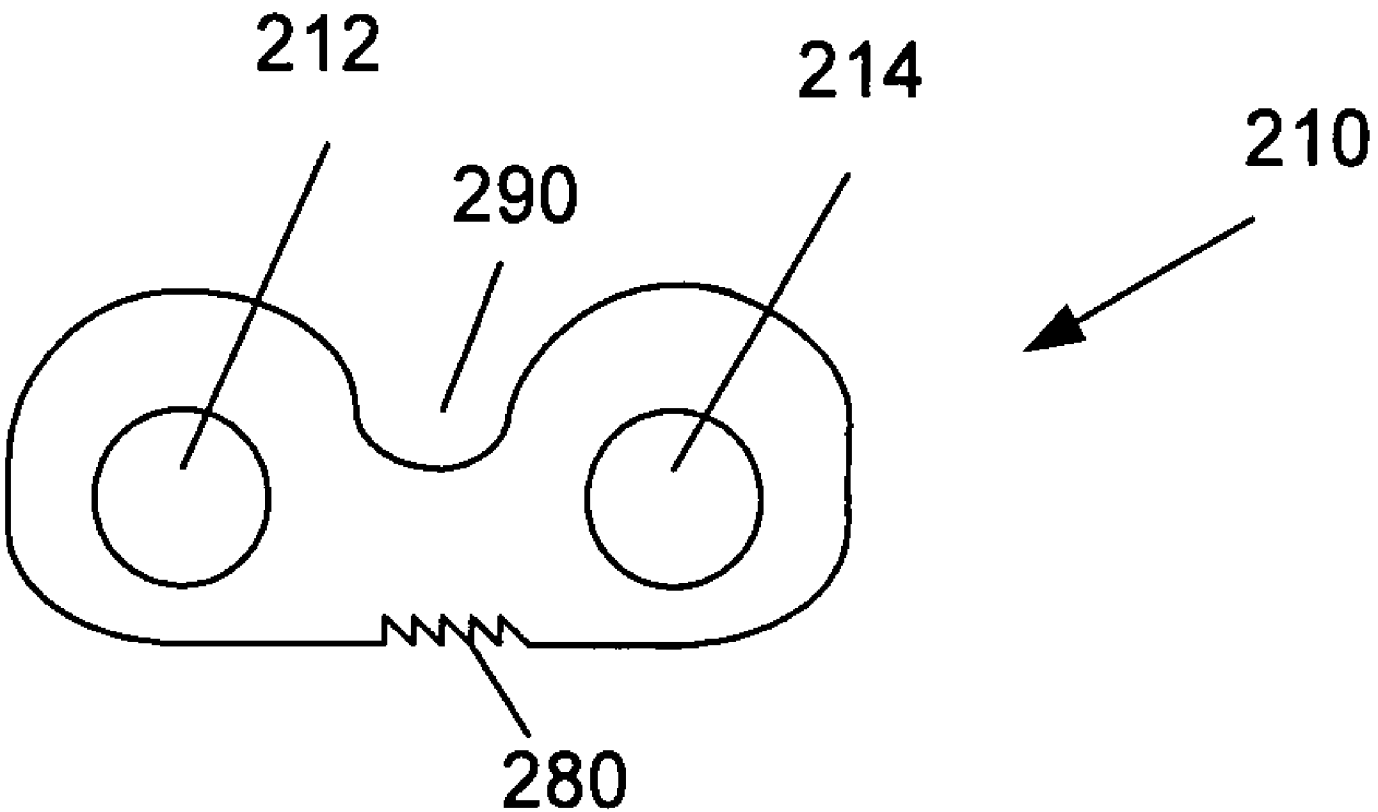
FIG. 6 shows a side view of the two-tube traffic sensing component utilized in the systems shown in either FIG. 4A or 4B.

Referring now to FIG. 4A as well as to FIG. 5, which shows a top perspective view of the two-tube component 210, and FIG. 6, which shows a side view of the two-tube component 210, a first rubber connector tube 240 provides an air-tight coupling of the left tube 309 of the three-tube component 301 to the left side-tube 212 of the two-tube component 210, while a second rubber connector tube 250 provides an air-tight coupling of the right side-tube 308 of the three-tube component 301 to the right side-tube 214 of the two-tube component 210. The first and second rubber connector tubes 240, 250 can be positioned on a portion of the road corresponding to where the first lane of traffic and the second lane of traffic meet (e.g., the dashed lines on the road separating the first and second lanes of traffic), so that they are subject to little stress from traffic passing thereover.

As seen best in FIG. 5, the two-tube component 210 includes barbed tube connectors 216, 218 on one end of each of the left-side and right side tubes 212, 214. The barbed tube connectors 216, 218 allow the first and second rubber connector tubes 240, 250 to be coupled to the left-side and right side tubes 212, 214 in a secure, air-tight manner, and to allow air to pass from within the tubes 212, 214 to the rubber connectors 240, 250. In one possible implementation of the first embodiment, the first and second rubber connector tubes 240, 250 are a few inches (e.g., 1 to 6 inches) in length. The other end of the two-tube component 210 is open, whereby one of the two tubes has a plug provided at that other end, to be described in detail hereinbelow.

Figure 7:
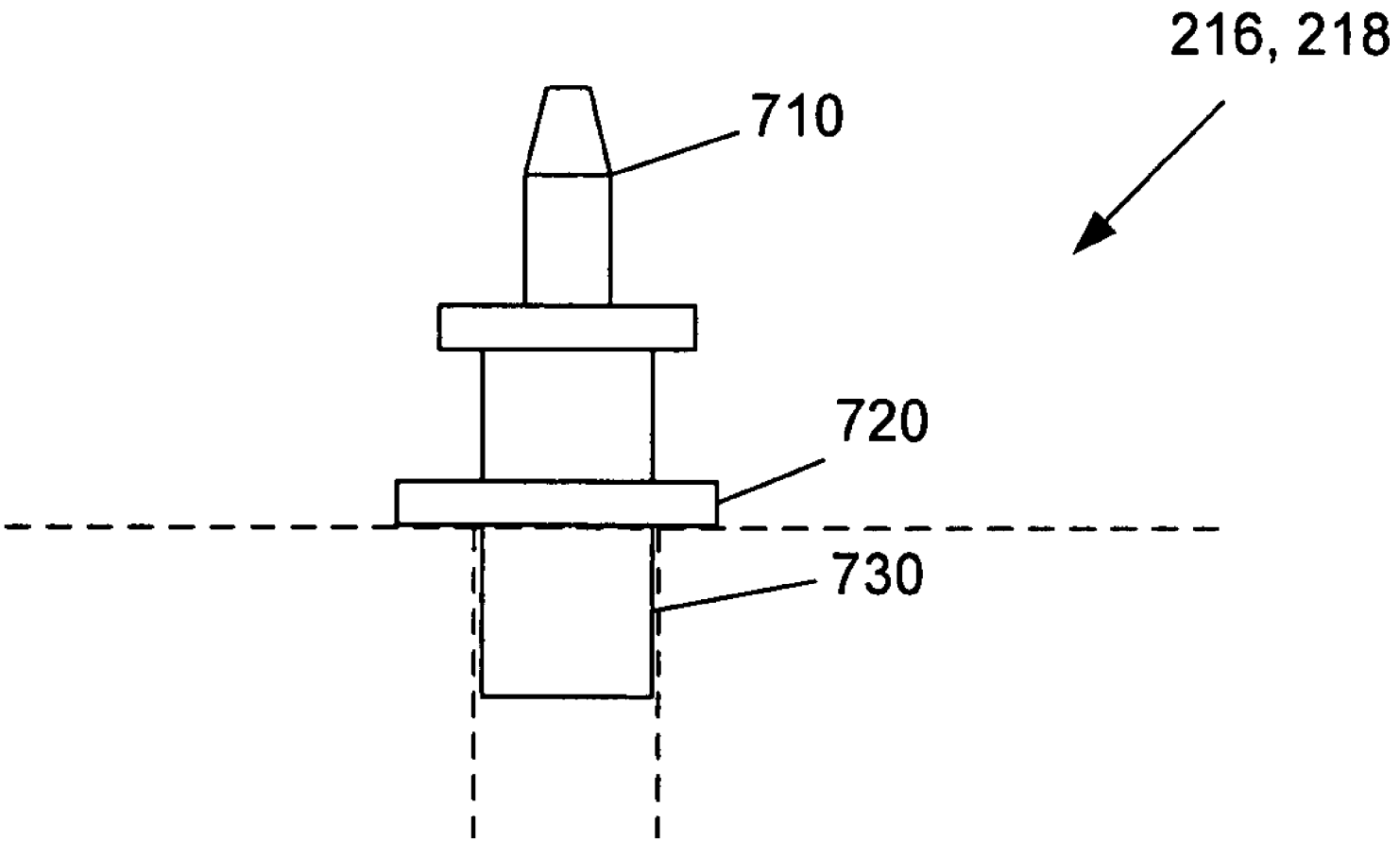
FIG. 7 shows details of a barbed connector that may be utilized in the systems shown in either FIG. 4A or 4B.
Figures 8A, 8B, 8C, 8D, 8E, 8F, 8G:
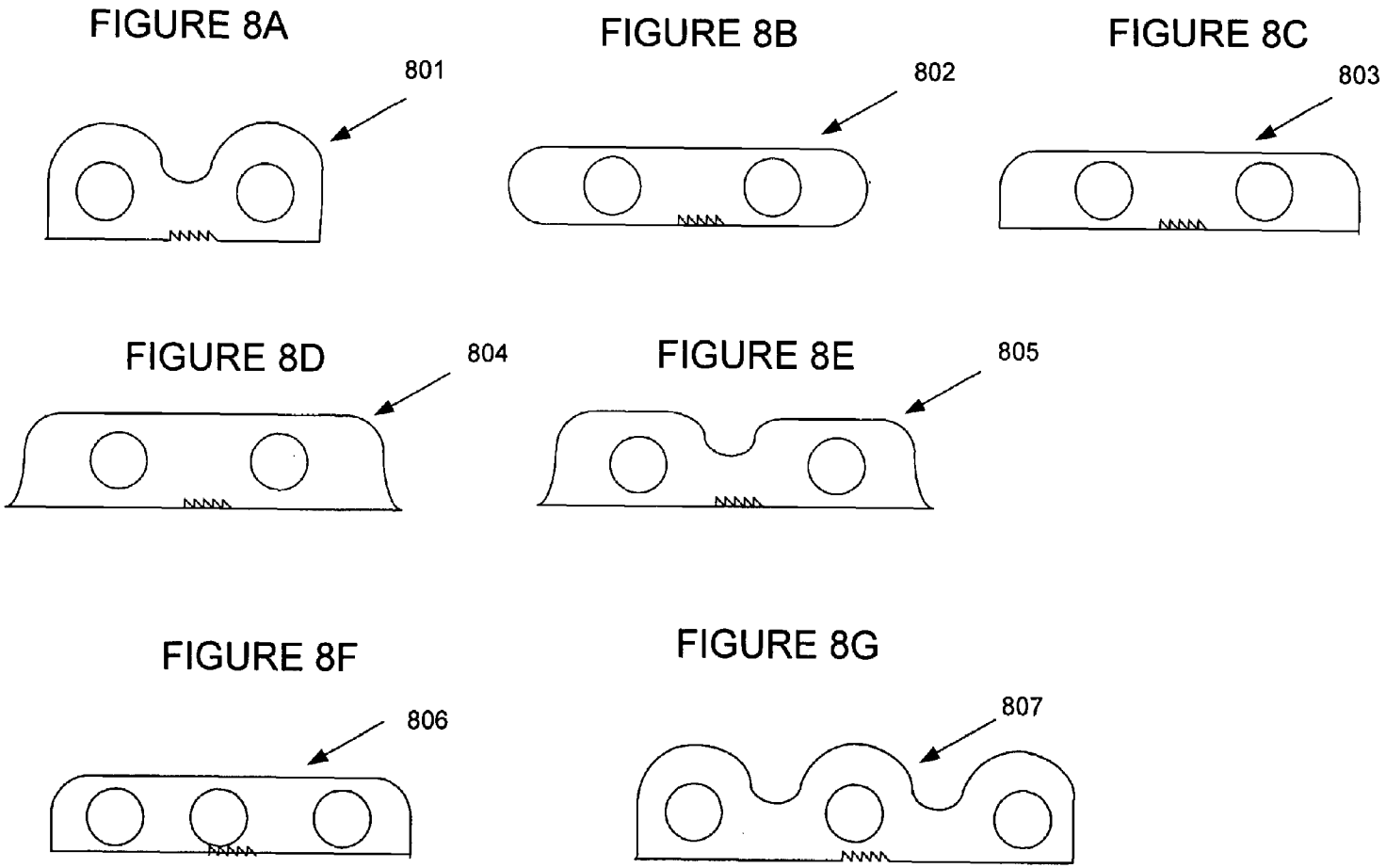
FIGS. 8A-8G show different housing structures for a two- or a three-tube component that may be used in either the first or second embodiments.

FIG. 7 shows details of the barbed tube connectors 216, 218. Each barbed tube connector 216, 218 is sized so that its bottom portion 730 is fitted within the respective tube 212, 214 (shown as dashed lines in FIG. 7), whereby the top portion of the barbed connector 216, 218 has a flat part 720 that fits against the outer part of the respective tube 212, 214, to provide an air-tight fit. The barbed tube connectors 216, 218 are preferably glued in placed at the ends of the respective tubes 212, 214. The barbed tube connector 216, 218 also includes a nipple portion 710 for allowing the respective rubber connector tube 240, 250 to fitted thereto in an air-tight manner. One barbed tube connector 216 is preferably colored white, and the other barbed connector 218 is preferably colored black, so that installation of the traffic sensing system 300 may be made without any misconnections. The connectors may be a PVDF or Nylon material construction.

Referring back to FIG. 4A, a first plug 260 is provided at a middle position within the left-side tube 212, whereby that middle position may correspond to a portion of the road corresponding to where the second lane of traffic and the third lane of traffic meet (e.g., the dashed lines on the road separating the second and third lanes of traffic). With the first plug 260 in place within the left-side tube 212, any traffic passing over the third lane of traffic will not result in acoustic or pneumatic pulses being provided to the first bypass tube 309 of the three-tube component 301 (and thereby to a second detector/counter 222 provided at an end of the first bypass tube 309), since the first plug 260 will block those acoustic or pneumatic pulses from traveling into the portion of the left-side tube 212 disposed on the second lane of traffic. The first plug 260 may be a rubber or a plastic or a metal component, whereby it provides an air-tight seal within the left-side tube 212.

The first plug 260 may be fitted into the middle position of the left-side tube 212 by fitting the first plug 260 through an access hole 262 (shown as dashed lines in FIG. 4A) provided adjacent the middle position of the left-side tube 212. Once the first plug 260 is fitted in place, the access hole 262 is sealed by a sealant, so that no air can escape through the access hole 262 to the exterior environment. Also, a polypropelene woven mesh with a bithuthane mastic tape provided thereon may be laid over the access hole 262, in order to provide an even better seal and to facilitate the location of the plug during installation.

Accordingly, when a vehicle passes over the second lane of the road, it will make contact with the left-side tube 212. That contact deforms the left-side tube 212 to cause the top and bottom portions of the left-side tube 212 to come into contact (or come close to coming into contact) with each other. This causes an acoustic or pneumatic pulse to occur within the open interior of the left-side tube 212, whereby that acoustic or pneumatic pulse is detected and thereby counted by the second detector/counter 222 connected in an air-tight manner to an end of the left-side tube 309 (of the three-tube component 301). The second detector/counter 222 is provided at the edge of the road closest to the first lane (the edge of the road being an area which traffic does not pass over). The acoustic or pneumatic pulses due to vehicles passing over the third lane of the road and making contact with the portion of the left-side tube 212 on the third lane of the road are blocked from reaching the first rubber connector tube 240 (and therefore blocked from reaching the second detector/counter 222), due to the first plug 260.

To identify and count vehicles passing over the third lane of the road, an incompressible but flexible bypass tube 270 is fitted within the first 12 feet (the portion disposed on the second lane of the road) of the right-side tube 214. The bypass tube 270 may be made of hard, flexible plastic or hardened rubber or metal material, and is provided so that vehicles passing over the portion of the right-side tube 214 within the second lane of the road will not cause the right-side tube 214 to deform, and thus will not result in acoustic or pneumatic pulses being provided to a third detector/counter 224 connected in an air-tight manner to an end of the right-side bypass tube 308 of the three-tube component 301. The bypass tube 270 has a hollow center region to allow acoustic or pneumatic pulses to pass from a portion of the right-side tube 214 that is provided on the third lane of the road, whereby those acoustic or pneumatic pulses are received by the third detector/counter 224 (by way of the second rubber connector tube 250 and the right-side tube 308), and thereby detected and counted.

A second plug 280 is provided at an end of the right-side tube 214 that is at the edge of the third lane of the road (the edge of the road), in order that acoustic or pneumatic pulses caused by vehicles making contact with the right-side tube 214 on the third lane of the road are directed towards the third detector/counter 224. The material construction of the second plug 280 may be similar to the material construction of the first plug 260, or it may be different, depending upon the particular manufacturing process utilized.

By way of a vehicle sensing system 300 as shown in FIG. 4A, the right-most twelve feet (or fifteen feet, depending upon the width of lanes on the road for which traffic is to be sensed) of the left-side tube 212 that is provided over the second lane of the road corresponds to an active sensor region, while the left-most 12 feet (or 15 feet, depending upon the width of lanes on the road for which traffic is to be sensed) of the left-side tube 212 that is provided over the third lane of the road corresponds to an inactive sensor region. Similarly, the left-most twelve feet (or fifteen feet, depending upon the width of lanes on the road for which traffic is to be sensed) of the right-side tube 214 that is provided over the third lane of the road corresponds to an active sensor region, while the right-most 12 feet (or 15 feet, depending upon the width of lanes on the road for which traffic is to be sensed) of the right-side tube 214 that is provided over the second lane of the road corresponds to an inactive sensor region. With the three-tube component 301 counting vehicles passing over the first lane, and with the second-tube component 210 counting vehicles passing over the second and third lanes, a traffic counting system 300 is provided that is less costly to manufacture than the traffic counting systems described in U.S. patent application Ser. No. 10/270,389, and which is just as sturdy and accurate as those systems.

Figure 4B:
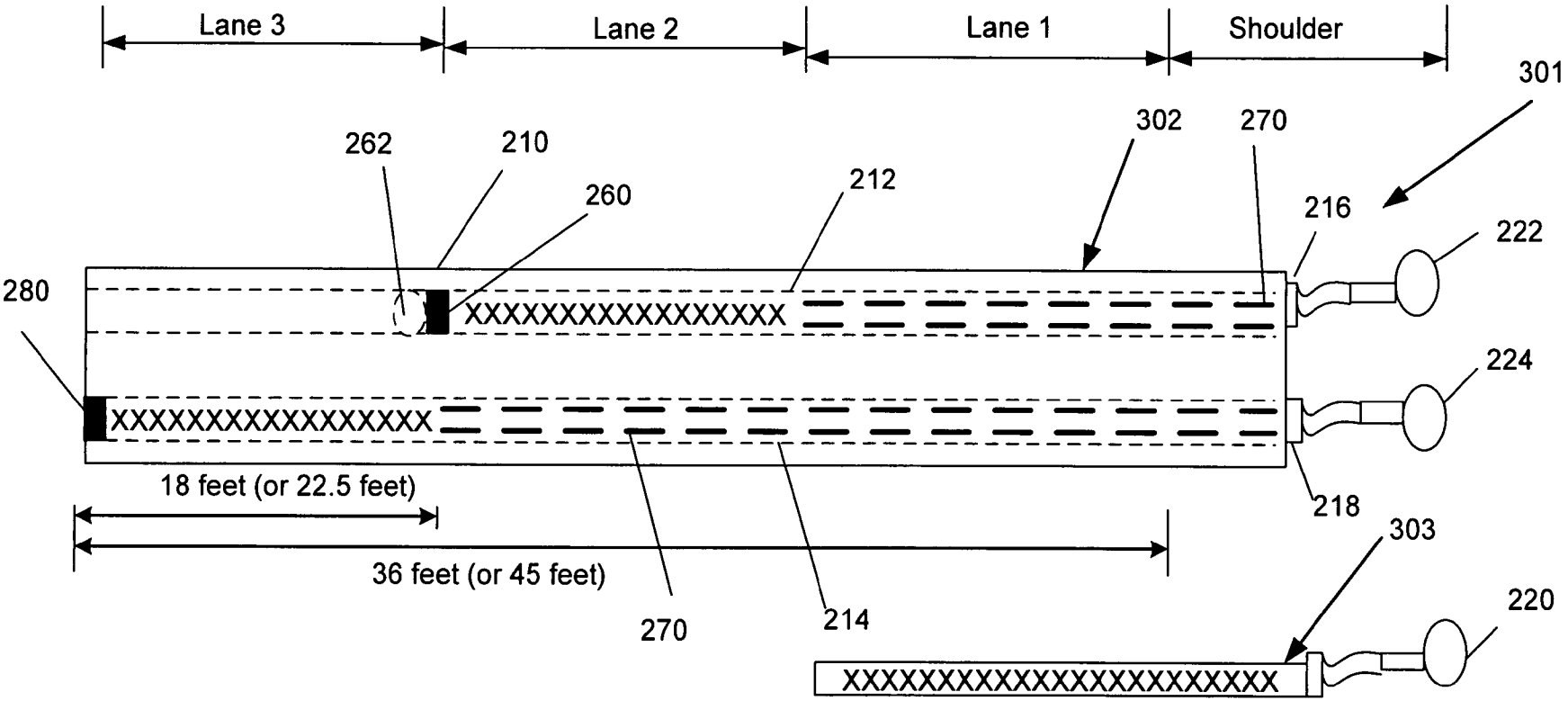
FIG. 4B shows a traffic sensing system according to a second embodiment of the invention

FIG. 4B shows a traffic sensing system 301 according to a second embodiment of the invention, for sensing traffic on three separate lanes of a road. The traffic sensing system 301 includes a two-tube component 302 that spans the entire three lanes of the road. The left side-tube 212 has a bypass tube 270 fitted into a first portion of the left side-tube 212 that corresponds to the first lane of the road. A second portion of the left side-tube 212 that spans the second lane of the road corresponds to an active region of the left side-tube, and is shown with XXXXs to indicate that in FIG. 4B. A plug 260 is provided at an area of the left side-tube 212 corresponding to where the second lane of the road and the third lane of the road meet. A detector 222 is connected to the left side-tube 212, whereby the detector 222 receives acoustic or pneumatic pulses that are used to sense and detect traffic passing over the second lane of the road.

The two-tube component 302 of the traffic sensing system 301 also includes a right side-tube 214 that has a bypass tube 270 fitted into a first portion of the right side-tube 214 that corresponds to the first and second lanes of the road. A second portion of the right side-tube 214 that spans the third lane of the road corresponds to an active region of the right side-tube, and is shown with XXXXs to indicate that in FIG. 4B. A plug 280 is provided at the end of the right side-tube 214. A detector 224 is connected to the right side-tube 214, whereby the detector 224 receives acoustic or pneumatic pulses that are used to sense and detect traffic passing over the third lane of the road.

The traffic sensing system 301 also includes a separate sensor 303 for sensing traffic passing over the first lane of the road. The separate sensor 303 may be a single tube sensor, or any other type of sensor, and is connected to a detector 220. As shown in FIG. 4B, the tube-tube component 302 and the separate sensor 303 span a length of the road that may include the shoulder of the road. In that regard, the two-tube component 202 is at least 45 feet in length to cover three 15-foot wide lanes, or is at least 36 feet in length to cover three 12-foot wide lanes, whereby an additional 2 feet or so is provided above those lengths to span a shoulder of the road.

As shown in FIG. 6, by way of example and not by way of limitation, each of the left side-tube 212 and the right side-tube 214 of the two-tube component 210 is 0.185" in diameter, with a 0.25" distance between the left side-tube 212 and the right side-tube 214. Also, by way of example and not by way of limitation, the two-tube component 210 is 0.375" in total height, and 0.85" in total width. The surface of the two-tube component 210 that is in contact with the road surface may be provided with ridges 280, so as to provide a good grip for maintaining the two-two component in place on the road. By way of example and not by way of limitation, the distance between adjacent ridges is 0.025". On the other side of the two-tube component 210 that contacts with vehicles passing thereover, a trough 290 may be provided, in order to increase the sensitivity of the left- and right-side tubes 212, 214 with respect to vehicles passing thereover. By way of example and not by way of limitation, the trough 290 has a 0.072" radius, and is provided in an area between the left-side tube 212 and the right-side tube 214.

FIGS. 8A-8G show alternate housing shapes 801, 802, 803, 804, 805, 806 and 807 of the two-tube component that may be utilized in either the first or second embodiments. The housing shapes 806 and 807 shown in FIGS. 8F and 8G include a third tube in the housing that may be used as the separate sensor 303 of FIG. 4B. In more detail, shape 801 and shape 807 have arcuate top surfaces over the tubes, with a trough between the tubes. Shape 802 has a flat top surface and arcuate side surfaces. Shapes 803 and 806 have flat top surfaces and flat side surfaces, with a curved region where the top surface and the side surfaces meet. Shapes 804 and 805 have parabolic shaped side surfaces, whereby shape 804 has a flat top surface and shape 805 has a trough on its top surface.

In one possible implementation of the first or second embodiment, the cover profile (housing) for the two-tube component is 60-70 shore A durometer EPDM rubber, the bypass tubes are Nylon or PVDF, the plugs are EPDM or silicon rubber or Nylon, and the connectors are Nylon or PVDF. As discussed above, other constructions for those elements of the tube-tube component may be utilized while remaining within the spirit and scope of the invention.

Many other changes and modifications may be made to the present invention without departing from the spirit thereof. The scope of these and other changes will become apparent from the appended claims. For example, while the present invention is described with respect to sensing and counting vehicular traffic on a road, other components, such as boxes traveling on a conveyor, may be sensed and counted by a system in accordance with the present invention. Also, other types of three-tube traffic counting components, such as the ones described in U.S. patent application Ser. No. 10/270,389, may be coupled to a two-tube traffic counting component as described above, in alternative implementations of the present invention.

What is claimed is:

1. A traffic sensing apparatus comprising:

a housing, the housing comprising:

a first tube that is provided along an entire length of the housing; and a second tube that is provided along the entire length of the housing;

a first connector provided at one end of the first tube and configured to couple with a first bypass tube that is attached at another end to another traffic sensing component; and a second connector provided at one end of the second tube and configured to couple with a bypass tube that is attached at another end to the another traffic sensing component; and a plug disposed within the first tube at a middle lengthwise position of the first tube, wherein the plug provides an air-tight seal within the first tube such that an active region and an inactive region of the first tube is thereby created.

2. The traffic sensing apparatus according to claim 1, wherein the vehicle traffic sensing component is configured to detect vehicles passing over first and second lanes of a road separate from a third lane of the road for which the another traffic counting component detects vehicles passing over.

3. A traffic sensing apparatus, comprising:

a housing, the housing comprising:

a first tube that is provided along an entire length of the housing; and a second tube that is provided along the entire length of the housing;

a first connector provided at one end of the first tube and configured to couple with a first bypass tube that is attached at another end to another traffic sensing component; and a second connector provided at one end of the second tube and configured to couple with a bypass tube that is attached at another end to the another traffic sensing component; and a plug disposed within the second tube at an end-position of the second tube; and a plastic hollow cylindrical tube provided within a first portion of the second tube, wherein the first portion of the second tube corresponds to an inactive region of the second tube and wherein a second portion of the second tube in which the plastic hollow cylindrical tube is not provided corresponds to an active region of the second tube.

4. The traffic sensing apparatus according to claim 1, further comprising:

a plurality of ridges provided on one surface of the housing, wherein the plurality of ridges provide a grip for maintaining the vehicle traffic sensing component in place on a road.

5. The traffic sensing apparatus according to claim 4, further comprising:

a trough provided on another surface of the housing opposite the one surface of the surface, wherein the trough is provided between the first and second tubes so as to increase a sensitivity to traffic for the first and second tubes.

6. A traffic sensing system, comprising:

a three-tube traffic sensing component, comprising:

a housing;

a first tube provided in a center portion of the housing, the first tube being configured to detect traffic passing over a first lane of a road on which the three-tube traffic counting component is provided;

a second tube provided at a side portion of the housing, the second tube corresponding to a first bypass tube; and a third tube provided at a side portion of the housing, the third tube corresponding to a second bypass tube; and a two-tube traffic counting component, comprising:

a housing a first tube that is provided along an entire length of the housing;

a second tube that is provided along the entire length of the housing;

a first connector provided at one end of the first tube and configured to couple with a first bypass tube that is attached at another end to another traffic sensing component; and a second connector provided at one end of the second tube and configured to couple with a second bypass tube that is attached at another end to the another traffic sensing component, wherein the two-tube traffic sensing component is provided on second and third lanes of the road, and wherein the two-tube traffic sensing component is connected to the three-tube traffic sensing component so as to detect traffic passing over the second and third lanes of the road.

7. The traffic sensing system according to claim 6, wherein the two-tube traffic sensing component further comprises:

a plug disposed within the second tube at an end-position of the second tube; and a plastic hollow cylindrical tube provided within a first portion of the second tube, wherein the first portion of the second tube corresponds to an inactive region of the second tube and wherein a second portion of the second tube in which the plastic hollow cylindrical tube is not provided corresponds to an active region of the second tube.

8. The traffic sensing system according to claim 6, wherein the two-tube traffic sensing component further comprises:

a plurality of ridges provided on one surface of the housing, wherein the plurality of ridges provide a grip for maintaining the vehicle traffic counting component in place on a road.

9. The traffic sensing system according to claim 6, wherein the two-tube traffic sensing component further comprises:

a trough provided on another surface of the housing opposite the one surface of the surface, wherein the trough is provided between the first and second tubes so as to increase a sensitivity to traffic for the first and second tubes.

10. A method of sensing traffic on a road having at least a first lane, a second lane, and a third lane of a road, the method comprising:

providing a three-tube traffic sensing component across the first lane;

connecting a counter/detector to one end of the three-tube traffic sensing component;

providing a two-tube traffic sensing component across the second and third lanes; and connecting the two-tube traffic sensing component to another end of the three-tube traffic sensing component, wherein the step of connecting the two-tube traffic sensing component to another end of the three-tube traffic sensing component comprises:

connecting one end of a first connector hose to a first tube of the two-tube traffic sensing component and connecting another end of the first connector hose to a first bypass tube of the three-tube traffic sensing component; and connecting one end of a second connector hose to a second tube of the two-tube traffic sensing component and connecting another end of the second connector hose to a second bypass tube of the three-tube traffic sensing component, wherein a third tube of the three-tube traffic sensing component corresponds to a traffic sensing tube that is positioned above the first and second bypass tubes and that is configured to sense traffic passing over the first lane.

11. The method according to claim 10, wherein a length of the three-tube traffic sensing component corresponds to a length of one lane of the road, and wherein a length of the two-tube traffic sensing component corresponds to a length of two adjacent lanes of the road.

12. The method according to claim 10, wherein the two-tube traffic sensing component includes first and second barbed tube connectors provided at one end of the first and second tubes of the two-tube traffic sensing component, respectively, and wherein the first and second connector hoses are respectively coupled to the first and second barbed tube connectors, in order to provide an air-tight fit.

13. A traffic sensing apparatus, comprising:

a housing, the housing comprising:

a first tube that is provided along an entire length of the housing; and a second tube that is provided along the entire length of the housing;

a first connector provided at one end of the first tube and configured to couple with a first bypass tube that is attached at another end to another traffic sensing component; and a second connector provided at one end of the second tube and configured to couple with a bypass tube that is attached at another end to the another traffic sensing component; and a plug disposed within the first tube at a position between a first end and a second end of the first tube, wherein the plug provides an air-tight seal within the first tube such that an active region and an inactive region of the first tube is thereby created, in which the active region is located between the first end of the first tube and a first end of the plug, and in which the active region is located between the second end of the first tube and a second end of the plug.

* * * * *